US006086379A

United States Patent [19]

Pendergast et al.

[11] Patent Number: 6,086,379

[45] Date of Patent: Jul. 11, 2000

[54] SYSTEM AND METHOD FOR TRAINING A SWIMMER

[75] Inventors: David Pendergast, Hamburg; Albert Termin, Kenmore; John Zaharkin, North Tonawada, all of N.Y.

[73] Assignee: Research Foundation of State University of New York, Amherst, N.Y.

[21] Appl. No.: 09/231,843

[22] Filed: Jan. 14, 1999

Related U.S. Application Data

[63] Continuation of application No. PCT/US98/22239, Oct. 20, 1998.

[60] Provisional application No. 60/062,428, Oct. 20, 1997.

[51] Int. Cl.[7] ..... A63B 69/12

[52] U.S. Cl. ..... 434/254

[58] Field of Search ..... 434/254, 247; 482/3, 55; 472/85

[56] References Cited

U.S. PATENT DOCUMENTS

| | | | |
|---|---|---|---|
| 3,465,592 | 9/1969 | Perrine | 73/379 |
| 3,731,921 | 5/1973 | Andrews | 272/71 |
| 3,846,704 | 11/1974 | Bessette | 325/66 |
| 4,082,267 | 4/1978 | Flavell | 272/125 |
| 4,396,904 | 8/1983 | Hanaoka | 340/309.15 |
| 4,479,647 | 10/1984 | Smith | 272/117 |
| 4,654,010 | 3/1987 | Havriluk | 434/254 |
| 4,805,631 | 2/1989 | Roi du Maroc, II | 128/710 |
| 5,325,340 | 6/1994 | Ramsey | 368/3 |
| 5,391,080 | 2/1995 | Bernacki et al. | 434/254 |
| 5,402,188 | 3/1995 | Wayne | 351/43 |
| 5,451,922 | 9/1995 | Hamilton | 340/309.15 |
| 5,524,637 | 6/1996 | Erickson | 128/482 |
| 5,556,353 | 9/1996 | Beers | 482/55 |
| 5,685,722 | 11/1997 | Taba | 434/254 |
| 5,685,723 | 11/1997 | Ladin | 434/254 |
| 5,697,792 | 12/1997 | Ladin | 434/254 |

FOREIGN PATENT DOCUMENTS

| | | | |
|---|---|---|---|
| 2175508 | 12/1986 | United Kingdom | 482/3 |
| WO 96/36404 | 11/1996 | WIPO | 482/3 |

*Primary Examiner*—Kien T. Nguyen
*Assistant Examiner*—Kurt Fernstrom
*Attorney, Agent, or Firm*—Hodgson, Russ, Andrews, Woods & Goodyear LLP

[57] ABSTRACT

A training system and method used to improve the biomechanics, distance per stroke, and aerobic metabolism of a swimmer is disclosed. The system employs a computer interface which allows a coach or a swimmer to input a particular training strategy using pace lights and timing system or, alternatively, using the system's internal training program. The system provides a generator to collect data from a swimmer. A part of the training system is designed to automate the data collection routine while operating in tandem with a swim meter. Another part of the system analyses the swimmers' performance and outputs the appropriate data to the pace light controlling circuitry.

14 Claims, 15 Drawing Sheets

FROM FIG.1A
START TIMER #0
TIMER #0 INTERRUPT EQUAL TO DELAY?
NO
RELOAD TIMER #0
YES
BLINK
2
TO FIG.1A
NO
DURATION COMPLETE?
YES
IS THERE A REPEAT?
NO
REQUEST ANOTHER LINE OF DATA TRIGGER BUFFER EXTERNAL INTERRUPT #0
1
2
START/LOAD TIMER #1
STORE TIMER #1 INTERRUPTS=>t1
EQUAL TO DELAY?
NO
RELOAD TIMER #1
LIGHT ON
LIGHT OFF
TURN LIGHT ON
NO
TURN LIGHT OFF
DONE BLINKING?
YES
DONE

SWIMMING PACER

PACER LIGHTS 1

PACER LIGHTS 2

PACER LIGHTS 3

PACER LIGHTS 4

SIMULATED RACE MODE

TAB TO HIGHLIGHT AND ENTER

FIG. 4

PACER LIGHTS 1

TRAINING PRACTICE FOR SWIMMER 1

| DISTANCE | NUMBER OF REPEATS | TRAINING SPEED | REST INTERVAL |
|---|---|---|---|
| 25 | 4 | :11.0 | :20 |
| 50 | 4 | :26.0 | :40 |
| 25 | 4 | :11.0 | :20 |

TOTAL TRAINING TIME: 8:30.00

FIG. 6

START TRAINING SESSION

PACER 1

PACER 2

PACER 3

PACER 4

START ALL PACERS

MONITOR TRAING SESSION

PACER 1-SWIMMER 1 2 3 4 5 6

PACER 2-SWIMMER 1 2 3 4 5 6

PACER 3-SWIMMER 1 2 3 4 5 6

FIG. 7

MAIN SELECTION WINDOW

PACER LIGHTS 1

SWIMMER 1

SWIMMER 2

SWIMMER 3

SWIMMER 4

SWIMMER 5

SWIMMER 6

USE ARROWS TO SELECT SWIMMER ESC WHEN FINISHED

FIG.8

RACE SIMULATION MODE

PACER LIGHTS 1

PACER LIGHTS 2

PACER LIGHTS 3

PACER LIGHTS 4

USE DOWN ARROWS TO SELECT THEN HIT ENTER

FIG. 9

SIMULATED RACE MODE

MANUAL

| STROKE | DISTANCE | TOTAL TIME |
|---|---|---|
| FLY | 200 | 2:09.00 |

| | |
|---|---|
| SPLIT 1 | :30.5 |
| SPLIT 2 | :32.5 |
| SPLIT 3 | :32.5 |
| SPLIT 4 | :33.5 |

PRE-PROGRAMED SPLITS

| STROKE | DISTANCE | ENTER TIME |
|---|---|---|
| FLY | 200 | 1:51.23 |

SPLITS FOR THE RACE APPEAR IN THIS WINDOW. SAME AS ABOVE WINDOW.

FIG. 10

SYSTEM AND METHOD FOR TRAINING A SWIMMER

CROSS REFERENCE TO A RELATED APPLICATION

This application is a continuation of international application number PCTUS/98/22239, filed Oct. 20, 1998, (pending). Applicants hereby claim priority on earlier filed U.S. provisional patent application Ser. No. 60/062,428, filed on Oct. 20, 1997, which application is incorporated herein by reference. International application number PCT/US98/22239 is incorporated herein by reference.

FIELD OF THE INVENTION

The present invention relates generally to the field of improving the performance of swimmers. More specifically, the invention pertains to a combination of equipment, software and training methods used to track and test biomechanical and metabolic characteristics of the swimmers' performance, improve biomechanical-aerobic parameters of a particular training technique, and evaluate the progress of the swimmers together with fine tuning the technical aspects of competition.

BACKGROUND ART

U.S. Pat. No. 5,391,080 describes a system which provides for control and monitoring of the application of positive and negative forces to the swimmer via electrodynamic means under control of an electronic controller as necessary for implementation of instruction/training protocols selected for the swimmer. That Patent call for means for applying positive and negative forces to a cable coupled to the swimmer and a control for controlling the force applied through the cable to the swimmer. The cable of that Patent has an electrically conductive component coupled to a swimmer, a sensor associated with the cable adjacent the swimmer, and a transmitter adjacent the swimmer for transmitting a signal from the swimmer to a receiver at the opposite end of the cable. That patent also discloses means for applying a positive force to the swimmer, a force sensor generating a signal in response to the force exerted by the swimmer, means generating a warning signal in response to the force sensor, a controller for varying the force applied to the swimmer, an accelerometer coupled to the swimmer and a transmitter coupled to the accelerometer.

U.S. Pat. No. 4,828,257 describes a weight lifting and training system and method for providing an exercise program at a desired pace throughout each repetition by applying resistance against a user's efforts based upon performance history and user demographics. That patent incorporates a central processing unit operating on the brake resistance. The system and method of that Patent can be used only by one trainee at a time.

U.S. Pat. No. 4,654,010 discloses a method and apparatus for measuring swimming technique using a pressure transducer worn by a swimmer and transmitting a signal from the transducer by radio to a remote receiver.

U.S. Pat. No. 4,082,267 relates to a bilateral isokinetic exerciser characterized by a plurality of limb engaging input means and associated mechanical arrangement including means for converting back and forth movement of the limbs into rotational input of mechanical components.

U.S. Pat. No. 3,731,921 discloses mechanical apparatus of the barrel type for simulating and developing swimming strokes. U.S. Pat. No. 4,479,647 is directed to a resistance exerciser which can be applied to swimming as shown in FIG. 10 of that Patent and characterized by the mechanical arrangement shown and described in the description and drawings. U.S. Pat. Nos. 4,805,631 and 3,465,592 are of general interest.

Unfortunately, none of the above-described Patents discloses a system and method which employ a computer interface utilizing the two main parameters that determine swimming success, namely the stroke frequency and the swimming speed. It would be desirable to have a system and method capable of setting the stroke frequency and the swimming speed for one or more swimmers during a practice session. Such system would allow a coach or a swimmer to program individual training sessions or to use new training programs to improve performance.

SUMMARY OF THE INVENTION

It is, therefore, an object of the present invention to provide a system able to determine the swimmer stroke mechanics, improve the mechanics and then provide a training regime which develops the metabolism for the swimmers to swim at improved speeds for the distances of competitive events.

It is also an object of the present invention to provide such a system by employing a computer interface which allows a user to set up performance parameters for individual training or for use of new training programs.

It is yet another object of the present invention to provide a method of training of one or more swimmers by setting up performance parameters of a swimmer, guiding the swimmer through the training session and monitoring progress or failure of the swimmer during each training program.

Briefly, the system and method of the present invention include: a) a swim meter and associated computer where the measured velocity and stroke rate of a swimmer provide a determination of peak, minimal and average speed along with stroke frequency and instantaneous changes in the speed of the swimmer and allows for calculation of the swimmer's passive drag and effectiveness of starts and turns; b) swim goggles with LEDs to communicate with the swimmer via a flashing signal or the like what part of the swim stroke the swimmer should be in thereby assisting the swimmer in achieving a particular stroke frequency; c) an arrangement of a plurality of computer controlled pace light strips to assist the swimmer in obtaining proper swimming speed; and d) a training model implemented by a computer program, to improve the biomechanics, distance per stroke and aerobic metabolism of the swimmer and allow the trainer to input strategy via the pace lights and timing system.

The present invention provides testing protocols on which the training technique is "prescribed". The testing involves a combination of instantaneous velocity measurement with video analysis over the entire range of stroke frequencies. The training is prescribed on a progressive routine involving both biomechanical and metabolic conditioning. The training is conducted by a pacing system that sets the speed and distance of swimming and can be interfaced with the desired stroke frequency. The computerized pacing system can be programmed by the coach or a "canned" program utilizing a particular training routine. The testing protocols are also used to evaluate the progress of the swimmers and allow "fine tuning" of the technical aspects of competition (starts, turn etc.).

Phase I: Testing a) Biomechanical. The basis of this phase is to establish the relationship between stroke frequency and velocity and to record the techniques that the swimmer is using. This is accomplished by a swim meter used in combination with one or more video cameras.

The swim meter is interfaced with a computer that records instantaneous velocity and stroke rate. The swim meter involves a DC motor, DC generator, a brake and a series of take up pulleys that apply tension to a line that is attached to the swimmer. The output of the DC motor is fed to a computer using an analog to digital converter board and is stored in the computer for future use. The computer software uses the information obtained from the swim meter and allows the determination of peak, minimal and average speed, along with stroke frequency and the instantaneous changes in speed of a swimmer. These data are then plotted as velocity vs stroke frequency, and distances per stroke are calculated. The software also allows for the calculation of the swimmers passive drag, and effectiveness of starts and turns.

The light-emitting-diode (LED) swim goggles that are used are described in U.S. Pat. No. 5,402,188, which is incorporated herein by reference. The purpose behind the goggles is to provide each swimmer with their own visible signal by way of a flash that communicates to the swimmer what part of their swim stroke they should be in. Thus, the goggles assist the swimmer in achieving a particular stroke frequency.

The pace light strip is used to visually assist the swimmers in obtaining the proper velocity. The light strip is placed at the bottom of the pool in the center of each lane such that the swimmers may swim directly over the light strip. The pace light strip of the type used in the present invention is commercially available from Pacer Products.

b) Metabolic. The metabolic aspects of swimming are analyzed using set swim protocols after which the presence and the level of venous blood lactic acid is determined. Swimmers swim for 50, 100, 200 and 400 meters as fast as possible and 8 min after the presence and the level lactic acid is determined. The rate of lactic acid accumulation is calculated and converted to an oxygen equivalent. These data are plotted as a function of swimming velocity and fitted exponentially to estimate the energy cost of swimming over the entire range of swimming speeds.

Phase II: Training

Biomechanical-Aerobic. Using the data from each individual swimmer the velocity/stroke frequency curve is shifted 5 to 15% and a new curve is constructed by the computer. The swimmers then swim at relatively slow speeds (compared to competition) however they are about 115% to 125% of the maximal aerobic speeds (which are very low compared to competitive speeds). The coach teaches, using video, the swimmer to shift to his/her new line at these low speeds. The swimmer develops the technique and his aerobic system is being maximal stress (lung-heart-blood flow-diffusion) and his muscle are trained to consume lactic acid. As the swim is above aerobic maximum, lactic acid builds up as a function of time and the swimmer has to stop after about 8–10 min. After a recovery period of 8–10 min of slow swimming, the swimmer's muscles have removed the lactic acid and swimmer can repeat another interval.

This process is repeated for one hour. During this period the swimming speed is gradually increased as the aerobic max increases and the swimmer is kept on the new line by the coach. After this part has been accomplished (curve shifted, muscles trained and aerobic max increased) the swimmer is shifted to 25 yard swims and the stroke frequency and velocity are increased, insuring that the swimmer stays on the new line. The rates and velocities are continuously increased until the peak velocity is achieved and during this phase the anaerobic/aerobic system is trained. The distances of these intervals can be increased to 50 or 75 yards (or longer) if desired.

Once this is accomplished the swimmers are retested and another shift in the curve is prescribed, and the entire process starts over.

To accomplish the program described above the present invention uses a computerized system that sets velocity and stroke rate, and with a video camera the coach can teach the swimmer. The velocity of swimming is set using a programmable series of under/above water lights called pace lights. This system consists of a computer, microprocessors and a light system. The system allows 24 swimmers, six in each of four lanes, to be trained simultaneously with a program prescribed individually for each swimmers, as described above. The computer can be programmed for repetitions of swims at specific speeds and distances and the microprocessors will drive the lights to pace the swimmer at the correct speed. The swimmer is either taught the correct stroke frequency or can be paced by a light/beeper system at the correct stroke frequency. One light strip lies on the bottom or is suspended over each of four pool lanes. The light system is built in such a way that it will run in one direction for 50 meters or up-and-back in a 25 yard pool. Thus the system operated by the computer/microprocessor can administer a specific program of stroke frequency and speed, the two most important factors in swimming, for six swimmers in each of four lanes. Each swimmer has a specific lighting code (number of light flashes) that he/she follows during the training. The pace light system consists of a dedicated computer (8 bit microprocessor) for each swimmer, a buffer microprocessor and a processor dedicated to scanning the groups of six processors. The data for training protocols are stored in a host personal computer. Parameters that are included in this initial setup are: swimmer identification, swim position in each lane (1–6), length of swim, time of swim (speed), rest interval, and number of repetitions of a given swim. The setup parameters are stored for further analysis and then can be downloaded to the buffer microprocessor which then feeds the data to the individual processor for each swimmer.

The downloading of data is accomplished through the PC's COM Port. The buffer then determines which one of up to 24 secondary dedicated computers receives the setups from the host computer. Communication is maintained to the dedicated processors by its internal UART (Universal Asynchronous Receive Transmit) interface. The host personal computer also has control of starting, stopping the swim and changing set-up parameters on the fly (on-line).

Data is monitored by one of a bank of six dedicated microprocessors. These data are constantly scanned by another dedicated processor which inputs data from the six processors through one of 56 decoding circuits. The dedicated processor takes the data and logically 'OR's the six processor data into groups of registers. The registers data are then transferred out to a bank of latched lamp drivers (lights). This cycle is repeated at a very high rate allowing 24 swimmers to be paced at individual speeds, distances and with varying rest intervals.

Phase III: Fine Tuning

The training described above is conducted on a two day on two day off schedule. On the "off" days, technical training is conducted using the light system and the swim meter.

Examples of this part of the training are: (1) very short (10 meter), max speed swims paced by the light system and/or assisted (2) working on swimming through turns using the light system which speeds up over the last meter and gets them to start swimming at the mean speed after the turn.

Examples of use of the swim meter and camera are: (1) starts or push off and glides to fine tune these so the swimmer loses the least amount of speed, (2) once this curve is established, the glide phase is quantitatively determined by determining when the first stroke should be taken to stay above the mean speed, (3) the swim meter is used to identify a period of drag (decelerations) during the stroke, which can then be associated with stroke techniques through the video.

The training system of the present invention can be set up to be used on short cycles with small shifts in the stroke frequency/velocity curves or on long cycles (fall and winter season in collegiate swimming) by making larger shifts in the curves. The devices used in the system and method of the present invention can stand alone and can be used by coaches for many application.

DETAILED DESCRIPTION OF THE PREFERRED EMBODIMENT

Swim profile is generated in a personal computer shown as A in FIG. 11 and is either stored or sent out to a lane via a serial port B in FIG. 11.

All lanes receive data sent by the personal computer A, but each lane has a code set to it identifying a particular lane as lane 1, lane 2, lane 3 etc. The personal computer's data output has a code in software designating which lane should accept the data and put the data in a data buffer D of a buffer processor C, shown in FIG. 12.

When all data are downloaded by the personal computer A, the buffer processor C directs a data selector E in FIG. 12 to select a counter which will receive the data. As illustrated in FIG. 12, counters F, G, H, J, K, L are capable of receiving data from he data selector E.

Data from the data buffer D are sent to each of the counters. The data buffer D holds a reserve of data of swim profiles for each swimmer. The counters F–L have a profile program into which various parameters for a specific swimmer or a training session can be loaded.

Upon a "start" command entered either from a hand held lane starter or the personal computer, the counters F–L start running.

Upon completion of a profile a counter requests an interrupt selector M, shown in FIG. 12, additional data from the buffer processor C. If a certain bit is set in any counter F–L, the counter will know that the profile running by that counter is the last profile. In such a case the counter will not request more data from the buffer processor C.

The processors of counters F–L generate a pulsing output upon an internal register reaching a programmed overflow. The output data from all six counters F–L are sent to a multiplexer N, shown in FIG. 12. The multiplexer 12 'OR's all active lane counters, no matter if only one counter or all counters are active. The multiplexer N is a combination of multiplexers and a microprocessor having 7 registers dedicated to storing the counter outputs. The data are then sent to a display driver P shown in FIG. 12.

A swim meter used in the present invention is of the type described in the article "Relationships of Stroke Rate, Distance Per Stroke, and Velocity in Competitive Swimming", Medicine and Science in Sports, Vol. 11, No. 3, pp. 278–283 (1979), which is incorporated herein by reference, and in Swimming (La Natation) by Costill, Maglischo and Richardson, an IOC Medical Commission Publication by Blackwell Scientific Publications, 215 pp, 1994, which is incorporated herein by reference. FIG. 18.1 on page 183 (FIG. 13 in the drawings) of Swimming particularly illustrates the swim meter preferred in the present invention.

The training program of the present invention is described below.

PACER LIGHT—TRAINING PROGRAM

Four sets of pacer lights
Each set of pacer lights can be programed up to 6 swimmers
Program should be configured to pace 50 meter and 25 yard incruments
If intermediate distances are used the program should begin the lights at the proper end of the pool.
All intermediate distances (meters)—50 meter to 3000 meters
All intermediate distances (yards)—increments of 25 yards to 3000
Should be able to program a number of repeat intervals, time for each training time fore each interval and a rest factor between each repetition
Program will be able to increase the speed of the lights at the turn end of the pool to increase turn speed. Increments of speed to be decided
A box before the computer com port to connect the number of pacer lights to be used during a training session.

Individual Program for each Swimmer

Program scheme for Swimmer 1
Select which pacer light to train on—Pacer 1
Select training distance—50 meters or 25 yards
Select swimmer number—Swimmer 1

From this point on a bar like program to enter training

Example below for Swimmer 1
Select pacer light to train on—1 through 4
Select swimmer number—1 through 6
Brings you into a traing screen for Swimmer 1
Refers to a line of training
Enter the distance to train—to configure the lights
Enter number of repititons
Enter rest interval between each repititon
Ability to enter a rest interval for a complete line
**Create screen in MS Word to show configuration with a box and lines like on Colorado
Example for Swimmer 1
Enter name—Optional

| Distance | Number of repitions | Training Speed | Rest Int |
|---|---|---|---|
| 25 | 4 | :11.5 | :30 |
| 50 | 4 | :26 | :55 |
| 25 | 4 | :11.5 | :30 |

Rest: 1:30

A rest interval line can be inserted at any point, and then more sets of any variety can be programed. A key reference at bottom of screen. (Along with Esc to main menu)

Repeat: 4

Indidual lines can be reentered as necessary but if a particular training pattern or a repeated pattern is desired, that particular pattern should be able to be repeated as many times a necessary by entering a number of times to repeat.

Training start

After all swimmers and training intervals are entered, the program will constantly update the screen and show each swimmer, for each set of pacer light, the interval number and the set.

Training lights can be started all together or each set of individual set of lights can be entered separately.

Stroke Frequency

Added to file to correlate training speed to stroke frequency. Allows tracking of swimmer over a period of time. ASCII file for import into spreadsheet.

As training sets are entered, a box that shows total time adds up the total time in minutes and seconds. May need to go to hours minutes and seconds if necessary.

Should be able to delete or backspace to any entry. Hitting enter will automatically move you to the next entry line.

The example above would require the lights to start at different ends of the pool based on what was entered. Program would automatically start at the proper end of the pool for each training interval entered.

A three second count-down before start, which could be hung on each starting block to count down the last three seconds of rest before each indiviual interval begins. Each swimmer should be able to review their training session. Screen at bottom gives Esc to main menu Program does not save. Automatically erases itself. Particlular training sessions can be named and saved for future use. Database should be able to save at least 100 workouts.

Enhancement

Stroke frequency velocity test and graph generation to compliment the training program of velocity.

Enhancement

Training sessions are saved to ASiI to be exported to spreadsheet for analysis by persons name so that training can be tracked over time for a particular person.

Race or Time Trial Enhancement

The program will let you enter a distance to complete. A set of pre-programed splits can be selected, or the incremental splits by 50 meter or yard increments can be entered. As incremental splits are entered, the total time is added until the splits are adjusted to acheive the time required.

DESIGN NOTES

FLOW CHART FOR TRAINER: RESIDENT SOFTWARE IN A PERSONAL COMPUTER THAT CONTAINS SWIM TRAINING DATA

FLOW CHART FOR BUFFER: REMOTE "SMART" DATA DISTRIBUTOR

1) FLOW CHART FOR COUNTER: DEVICE THAT ESSENTIALLY OUTPUTS THE LIGHT STROBBING INFORMATION.

2) THE FLOW CHART FOR THE COUNTER IS REPLICATED SIX (6) TIMES A SWIMMING LANE. IF FOUR LANES ARE INCORPORATED THEN THE COUNTER IS REPLICATED TWENTY FOUR (24) TIMES. THE COUNTER REPLICATION IS FOR EACH SWIMMER AND THEREFORE COULD BE UNLIMITED.

THE DECODER FLOW CHART IS NOT INCLUDED. THE DECODER SCANS A PARTICULAR SWIMMING LANE'S COUNTER OUTPUTS AND COMBINES THE DATA IN SUCH A WAY THAT ALL THE COUNTERS DATA WILL BE DECODED AND DISPLAYED ON THE STROBED LIGHTS. THIS DESIGN MAY CHANGE, ALTHOUGH THE END USER (SWIMMER(S)) WILL NOT BE AWARE OF ANY DIFFERENCE.

PLEASE REQUEST ANY MORE INFORMATION ON THE DECODER OR ENCLOSED FLOW CHARTS IF NEEDED.

What is claimed is:

1. A device for training a swimmer, comprising:

a signal emitter capable of mounting to the body of the swimmer, the signal emitter being capable of emitting a signal perceptible to the swimmer while swimming;

a pacing system disposed in spaced apart relation to the swimmer such that a pacing indication is perceptible to the swimmer while swimming; and, a control system capable of activating the signal emitter to produce the signal, and capable of activating the pacing system to provide the pacing indication, wherein when the control system is operating, the control system takes into account a swimming stroke frequency and a swimming velocity corresponding to training the swimmer.

2. The device of claim 1, wherein the signal emitted from the signal emitter corresponds to a predetermined swimming stroke frequency.

3. The device of claim 1, wherein the pacing indication corresponds to a predetermined swimming velocity.

4. The device of claim 1, wherein the signal emitter is attached to a pair of goggles worn by the swimmer.

5. The device of claim 1, wherein the pacing system is a plurality of pacing lights disposed along a swimming path followed by the swimmer.

6. The device of claim 1, wherein the control system is a microcomputer programmed to execute a predetermined swim training program through control of the signal to the signal emitter and through control of the pacing indicator.

7. The device of claim 6 wherein the swim training program comprises a progressive routine bases on biochemical and metabolic aspects of swimming.

8. A system for training at swimmer, comprising;

a signal emitter mounted to the body of the swimmer, the signal emitter capable of emitting a signal perceptible to the swimmer while swimming, the signal corresponding to a predetermined swimming stroke frequency;

a pacing system disposed in spaced apart relation to The swimmer such that a pacing indicator is perceptible to the swimmer while swimming, the pacing indication corresponding to a predetermined swimming velocity;

a swim metering device for measuring the velocity of the swimmer; and a control system capable of activating the signal emitter to produce the signal and capable of activating the pacing system to provide the pacing indication, the control system controlling the signal and the pacing indication according to a predetermined swim training program based at least in part on measurements from the swim metering device and the predetermined stroke frequency.

9. The system of claim 8, wherein the signal emitter is attached to a pair of goggles worn by the swimmer.

10. The system of claim 8, wherein the pacing system is a plurality of pacing lights disposed along a swimming path followed by the swimmer.

11. The system of claim 8, wherein the swim metering device comprises a wire attached to the swimmer at a first end and attached to a rotating device at a second end.

12. The system of claim 11, wherein the rotating device is a DC generator, the DC generator providing an output voltage proportional to the velocity of the swimmer.

13. The system of claim 11, wherein the swim training program is a progressive routine based on the biochemical and metabolic aspects of swimming.

14. A method of training a swimmer, comprising the steps of:

providing a swim metering device for calculating a swimming velocity of the swimmer;

detecting a swimming stroke frequency of the swimmer;

testing for venous blood lactic acid levels at predetermined swimming distances;

providing a swim training program based on the swimming velocity, swimming stroke frequency and venous blood lactic acid levels;

providing a swim training device comprising a signal emitter mounted to the body of the swimmer, the signal emitter capable of emitting a signal perceptible to the swimmer while swimming; a pacing system disposed in spaced apart relation to the swimmer such that a pacing indication is perceptible to the swimmer while swimming; and, a control system capable of activating the signal emitter to produce the signal and capable of activating the pacing system to provide a pacing indication, the control system controlling the signal and the pacing indication according to the swim training program.

* * * * *

UNITED STATES PATENT AND TRADEMARK OFFICE

CERTIFICATE OF CORRECTION

PATENT NO. : 6,086,379

DATED : July 11, 2000

INVENTOR(S) : Pendergast et al.

It is certified that error appears in the above-identified patent and that said Letters Patent is hereby corrected as shown below: On the title page, Item [57]
In the Abstract - line 11, "analyses" should be -- analyzes --.

Fig. 7, line 7 - "TRAING" should be -- TRAINING --.

Col. 1, line 32 - "call" should be -- calls --.

Col. 5, line 35 - "he" should be -- the --.

Col. 6, line 10 - "incruments" should be -- increments --.

Col. 6, line 18 - "fore" should be -- for --.

Col. 6, line 36 - "traing" should be -- training --.

Col. 6, line 39 - "repititons" should be -- repetitions --.

Col. 6, line 40 - "repititon" should be -- repetition --.

Col. 6, line 49 - "repitions" should be -- repetitions --.

Col. 6, line 59 - "Indidual" should be -- Individual --.

Col. 7, line 17 - "indiviual" should be -- individual --.

Col. 7, line 44 - "STROBBING" should be -- STROBING --.

Signed and Sealed this

Second Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 6,086,379
DATED : July 11, 2000
INVENTOR(S) : Pendergast et al.

It is certified that error appears in the above-identified patent and that said Letters Patent is hereby corrected as shown below:

Col.2, line 51—delete "The present invention", and insert therefor

-- BRIEF DESCRIPTION OF THE DRAWINGS

For a fuller understanding of the nature and objects of the invention, reference should be made to the following detailed description taken in conjunction with the accompanying drawings, in which:

Figures 4-10 are displays presented to a user of a device according to the present invention;

UNITED STATES PATENT AND TRADEMARK OFFICE

CERTIFICATE OF CORRECTION

PATENT NO. : 6,086,379
DATED : July 11, 2000
INVENTOR(S) : Pendergast et al.

Figure 1A:
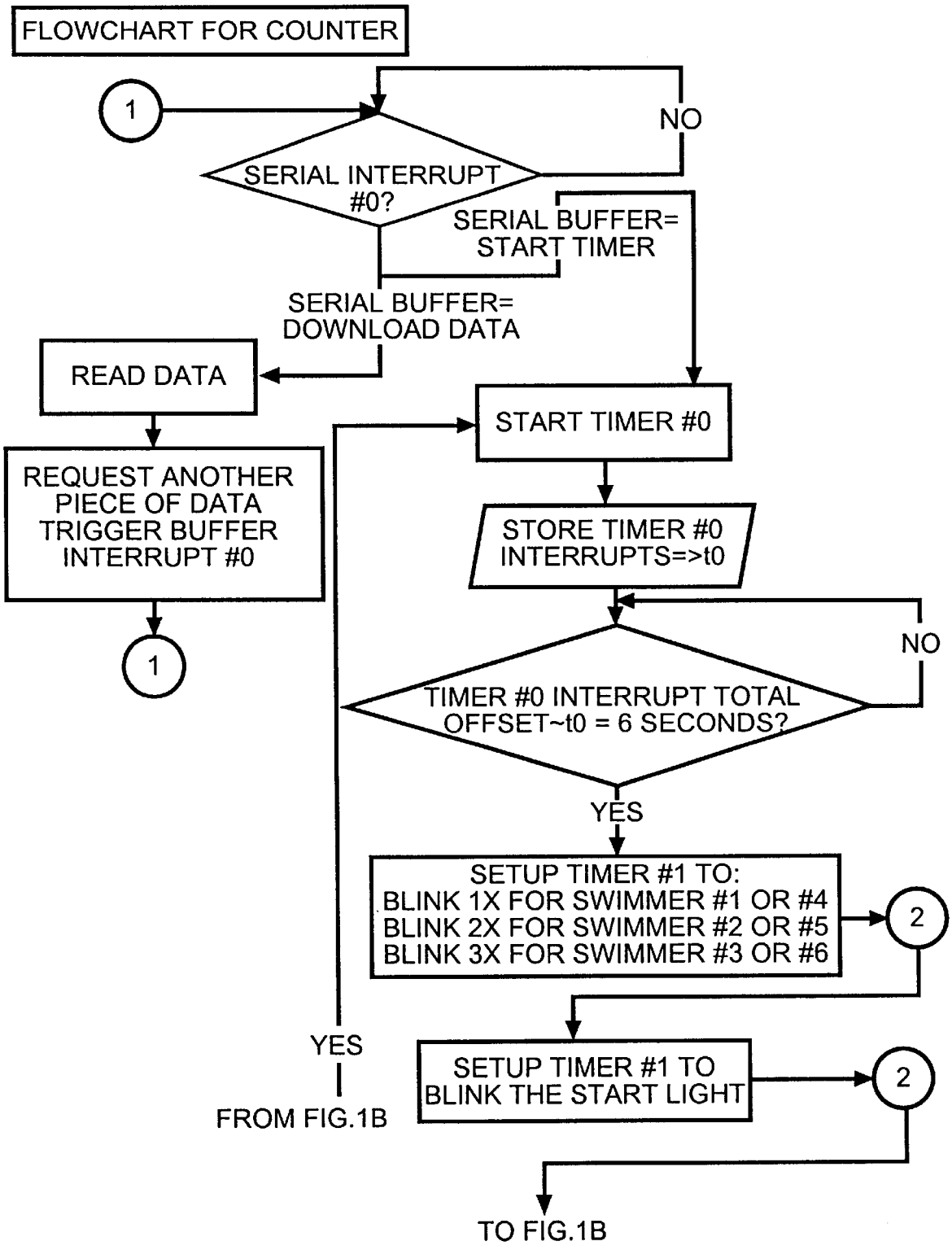
Figure 1 is a flow chart for a counter according to the present invention.
Figure 1B:
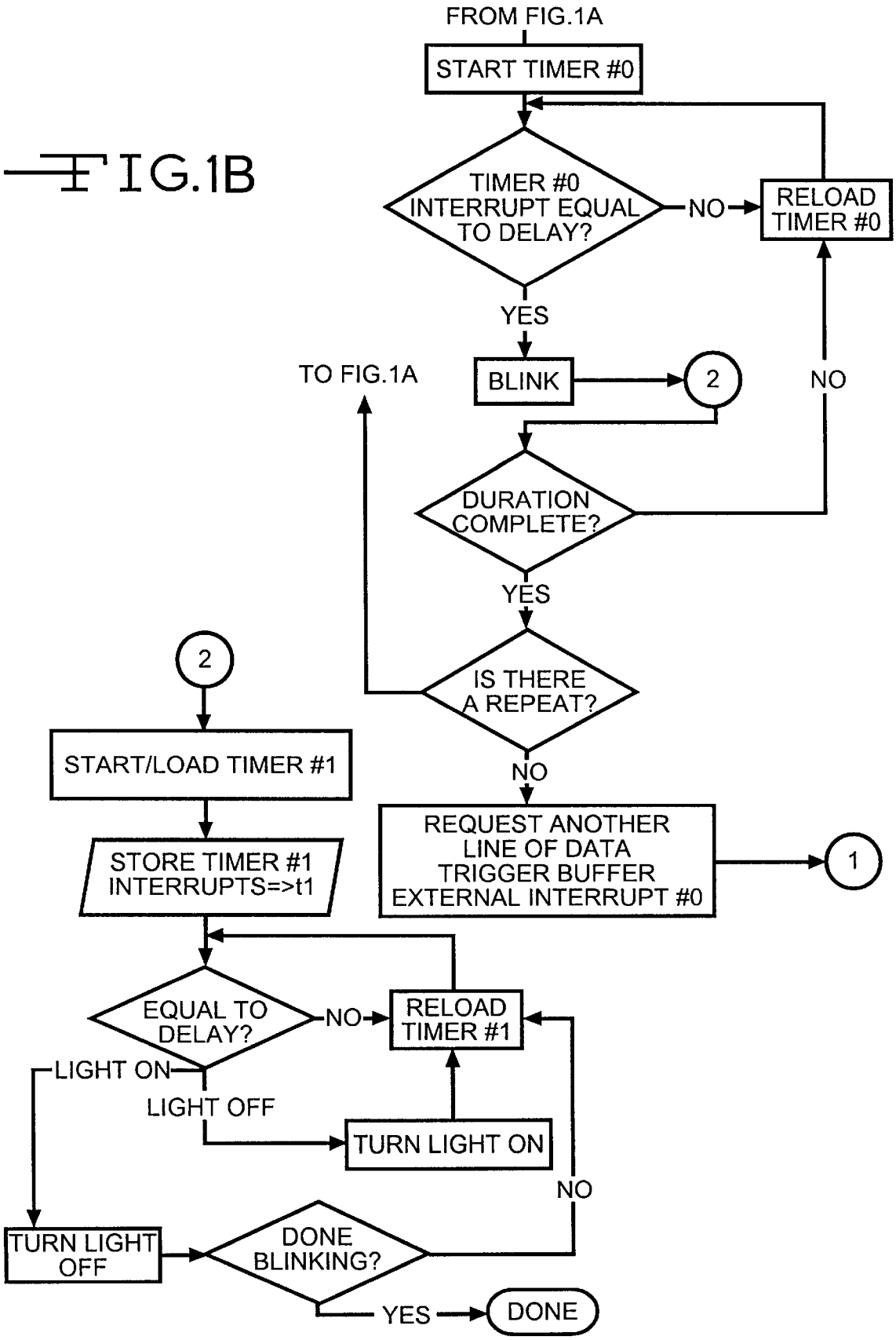
Figure 2A:
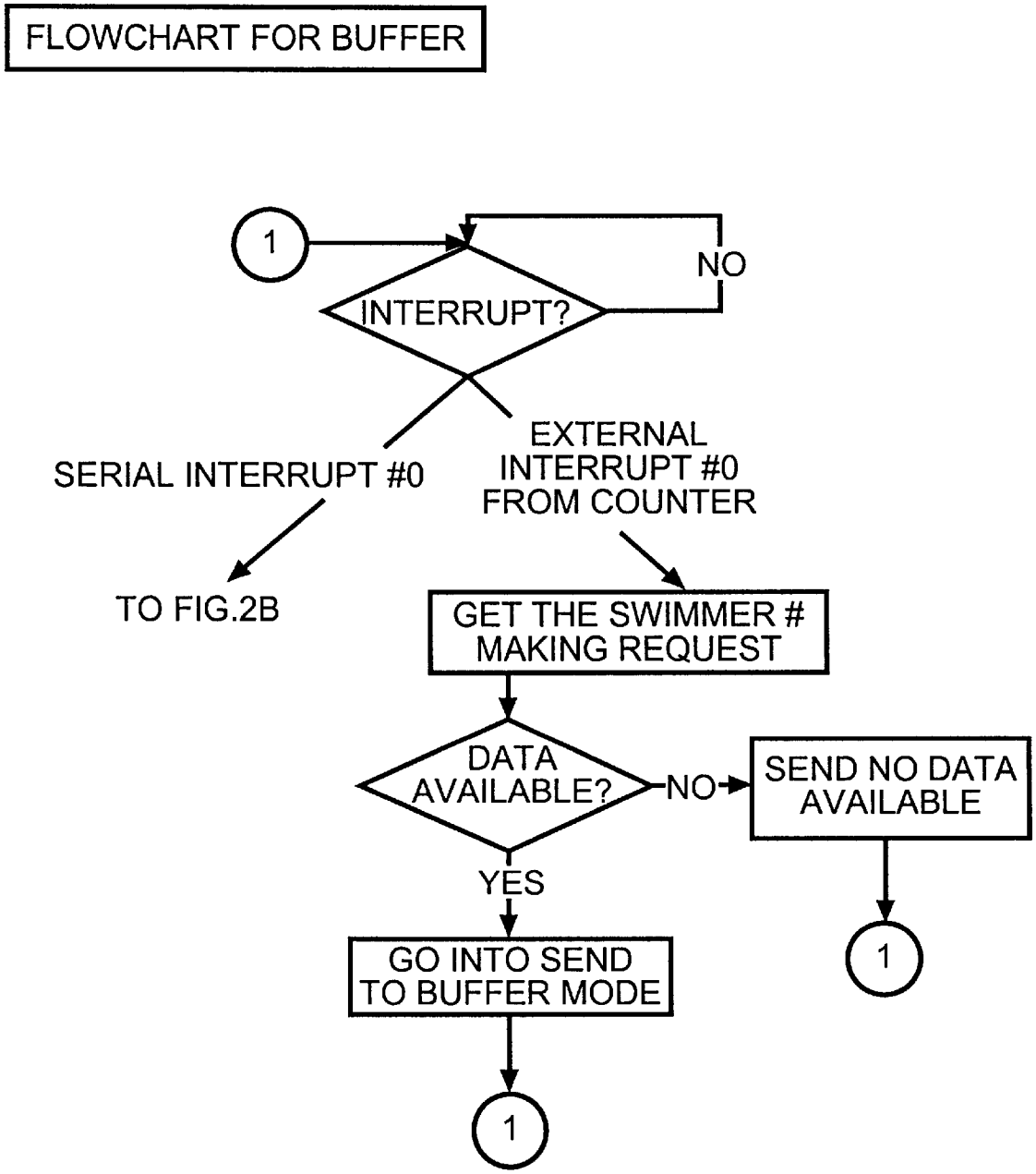
Figure 2 is a flow chart for a buffer according to the present invention used in a device according to the present invention.
Figure 2B:
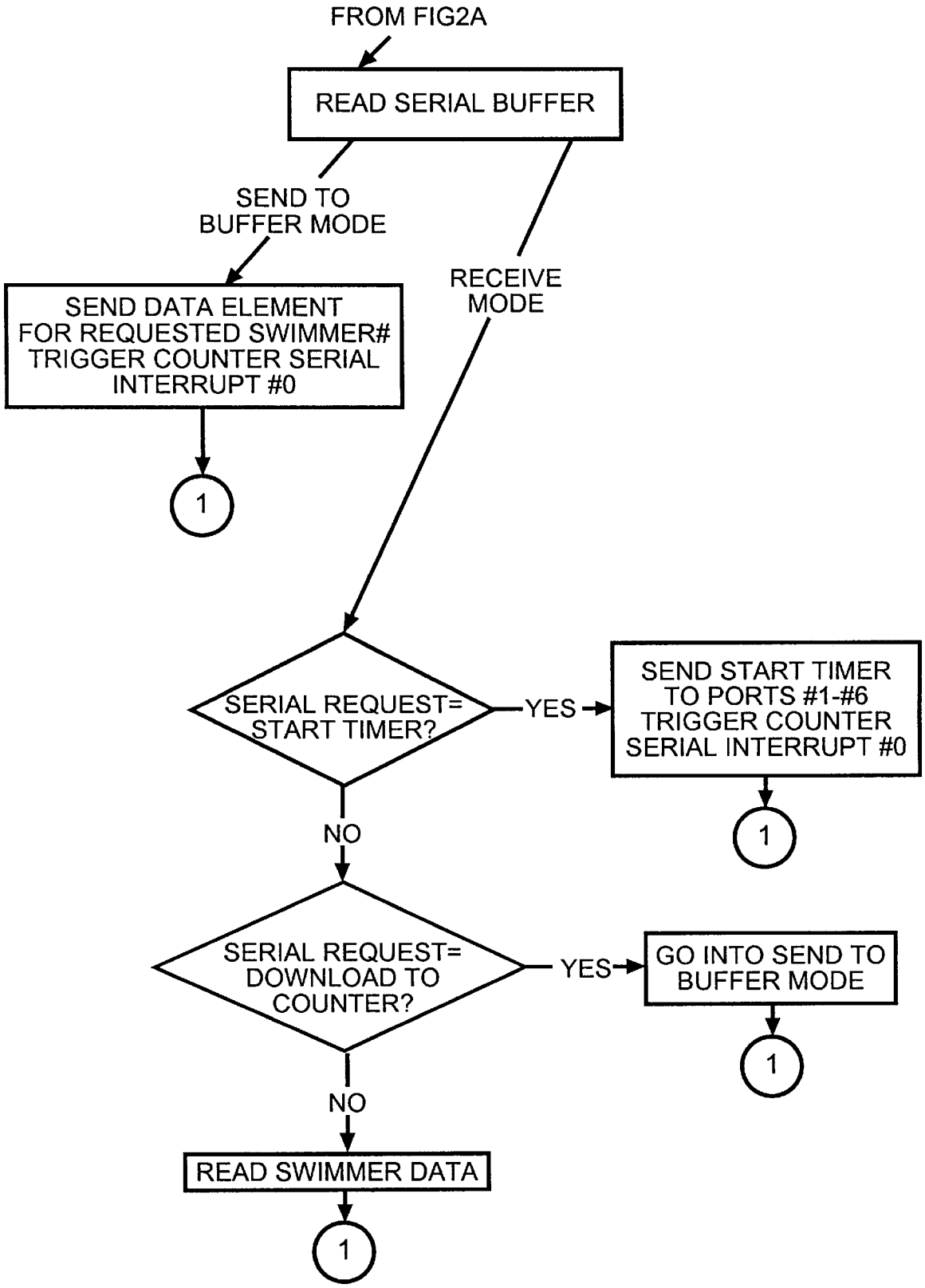
Figure 3:
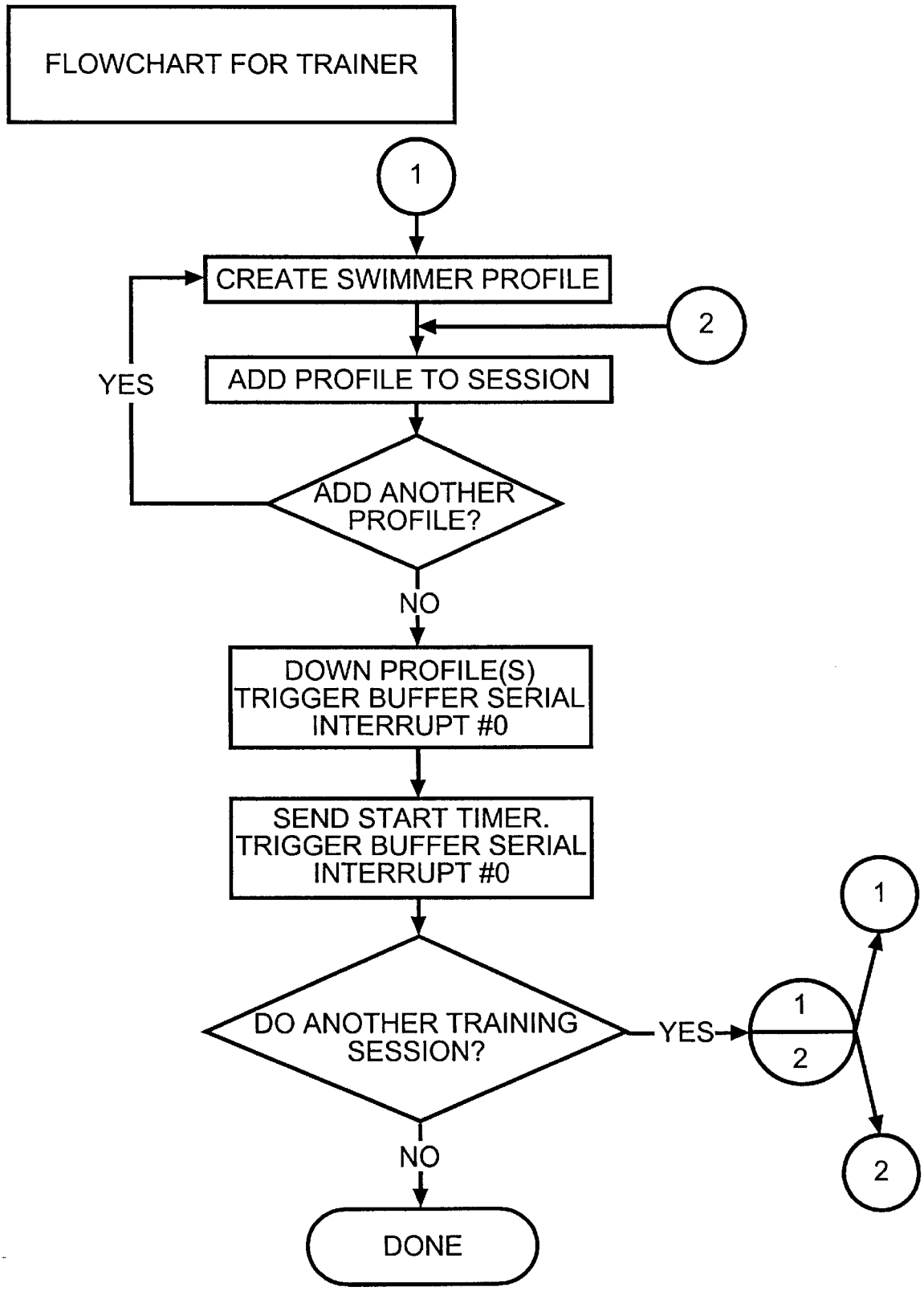
Figure 3 is a flow chart for creating and adding a profile to a device according to the present invention.
Figure 5:
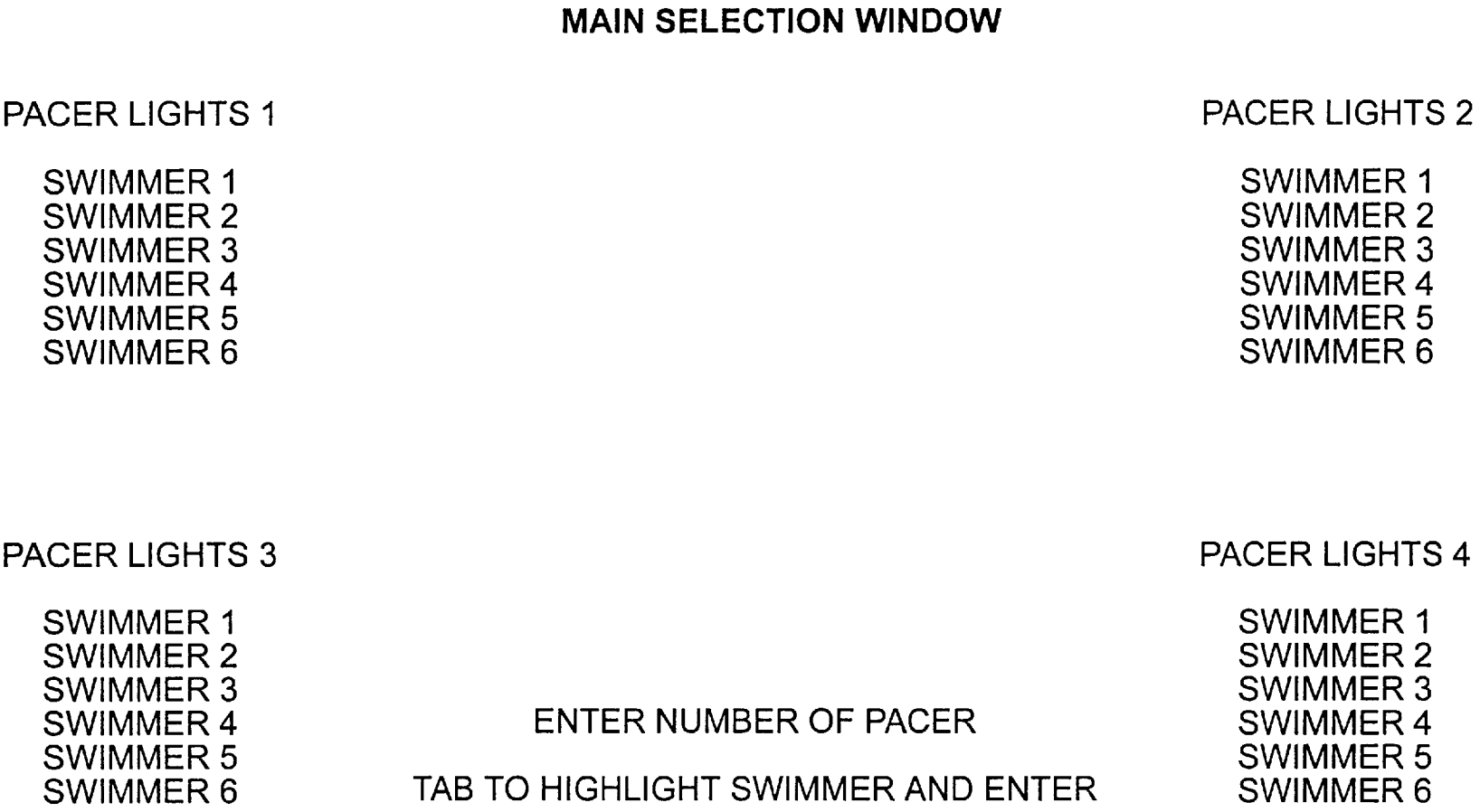
Figure 11:
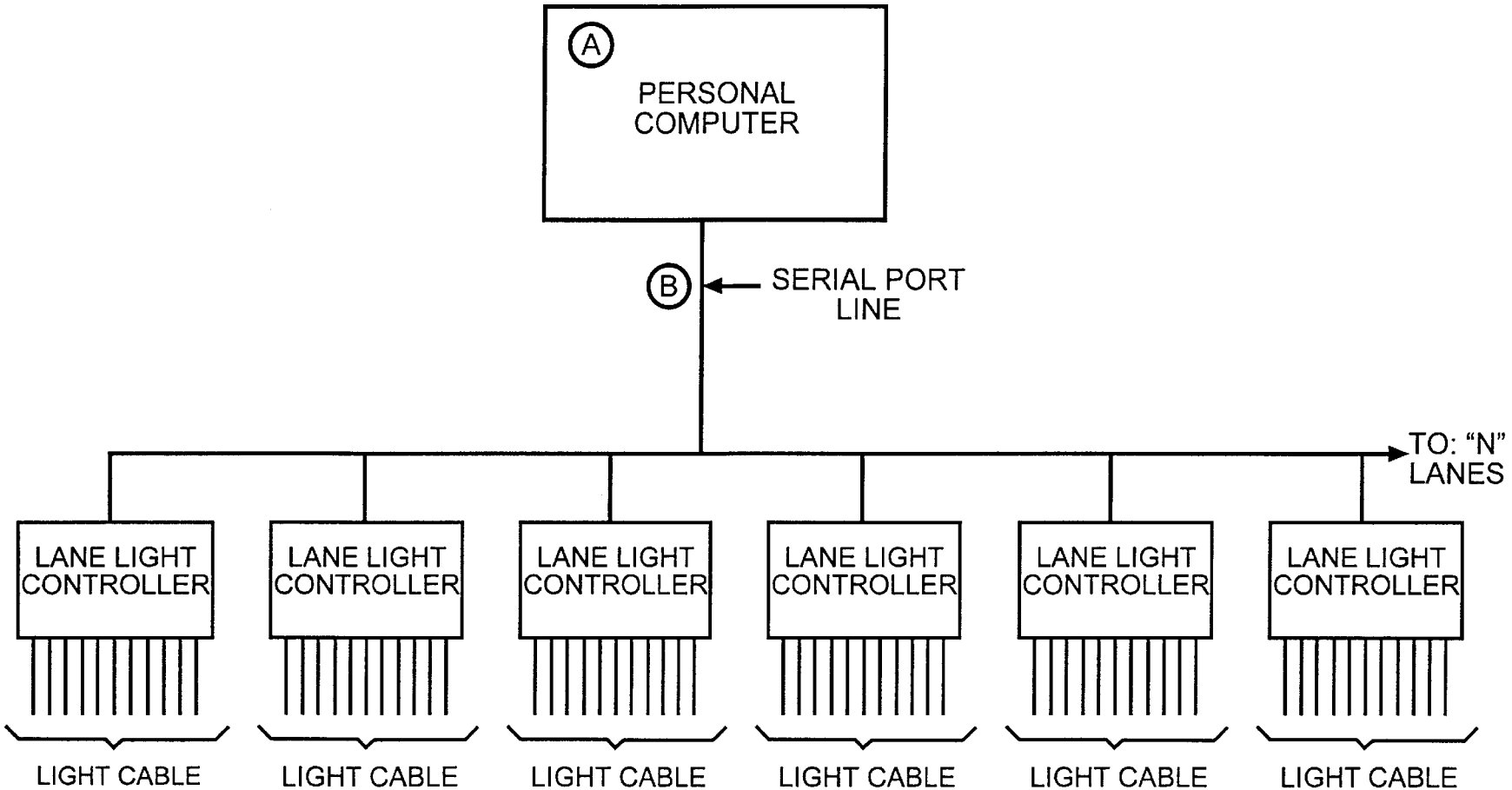
Figure 11 is a schematic of part of a device according to the present invention.
Figure 12:
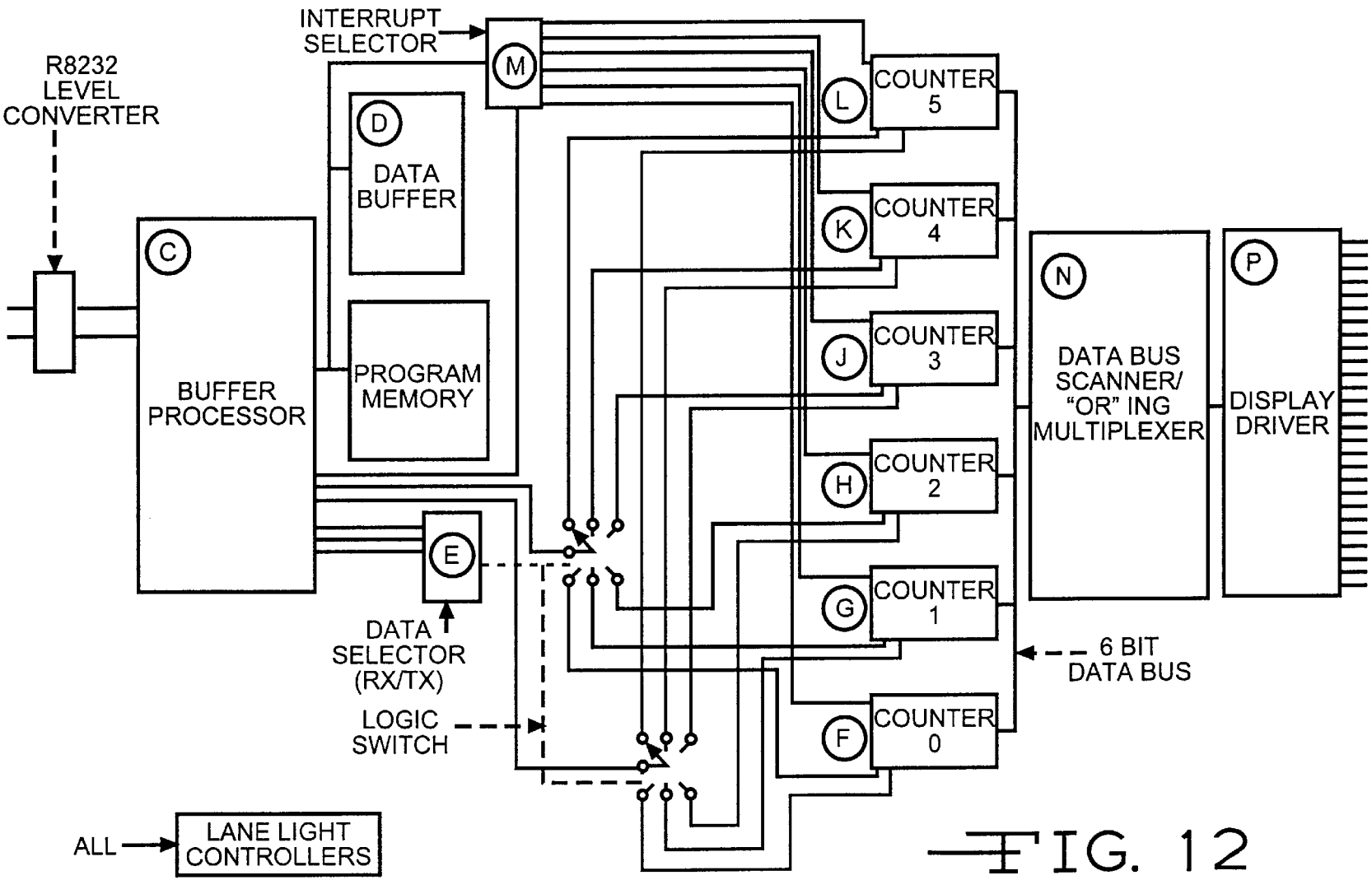
Figure 13:
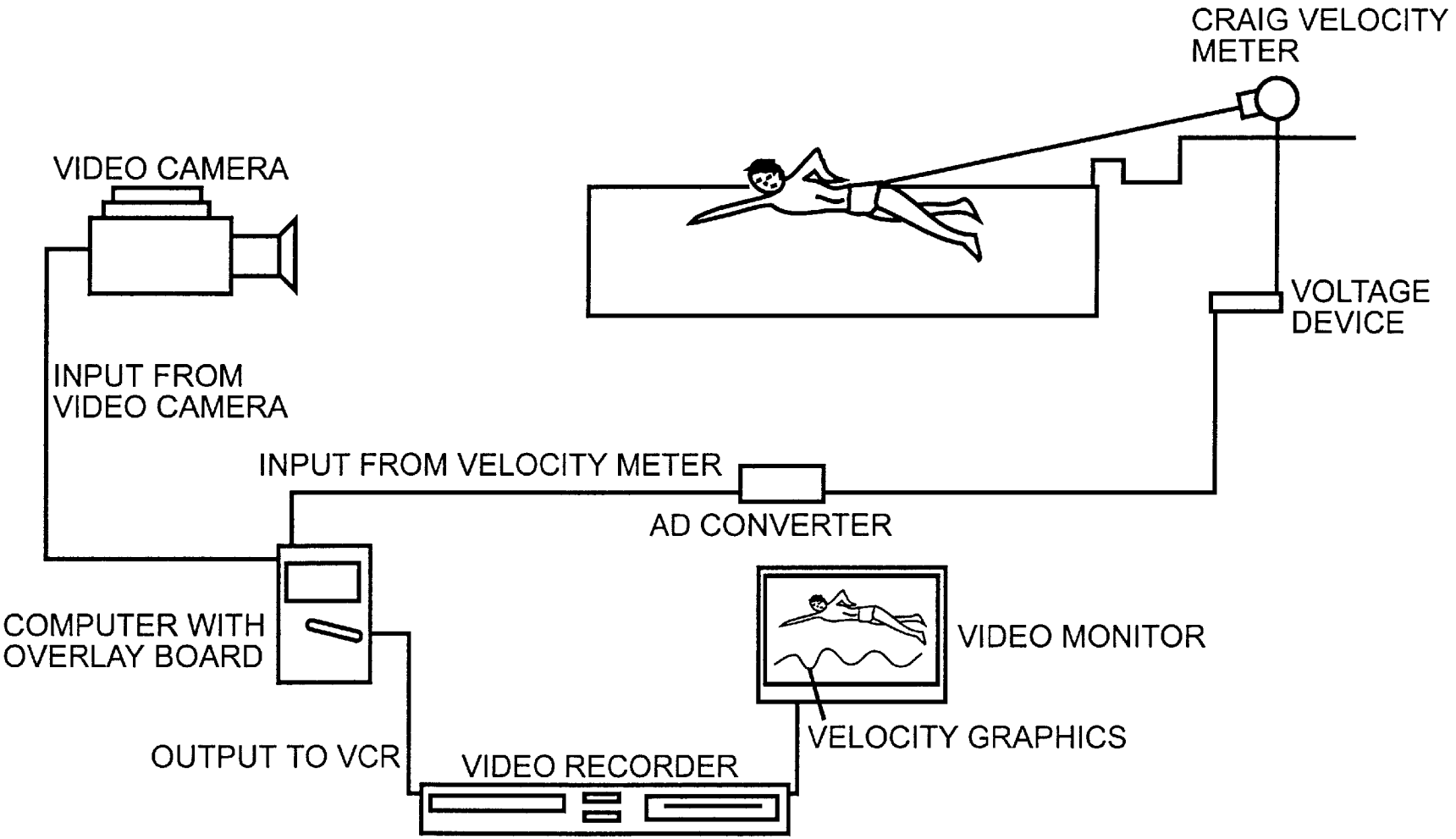

It is certified that error appears in the above-identified patent and that said Letters Patent is hereby corrected as shown below:

Figure 12 is a schematic of part of a device according to the present invention; and Figure 13 illustrates a swim meter that could be used in the present invention.

DETAILED DESCRIPTION OF THE PREFERRED EMBODIMENT

The present invention --.

Col. 5, lines 20-21 delete "DETAILED DESCRIPTION OF THE PREFERRED EMBODIMENT".

Col. 5, line 22—delete "Swim" and insert --A swim --.

Col. 8, line 28 - "at" should be -- a --.

Signed and Sealed this

Twelfth Day of June, 2001

Nicholas P. Godici

*Attest:*

*Attesting Officer*

NICHOLAS P. GODICI
*Acting Director of the United States Patent and Trademark Office*